US005317824A

United States Patent [19]

Hull

[11] Patent Number: 5,317,824

[45] Date of Patent: Jun. 7, 1994

[54] SIGN ASSEMBLIES

[75] Inventor: Graham Hull, Uppingham, England

[73] Assignee: Nathaniel Oliver & Associates, Ltd., Leicestershire, Great Britain

[21] Appl. No.: 847,958

[22] Filed: Mar. 5, 1992

[30] Foreign Application Priority Data

Sep. 19, 1991 [GB] United Kingdom ..... 9120045

[51] Int. Cl.[5] ..... G09F 7/08

[52] U.S. Cl. ..... 40/611

[58] Field of Search ..... 40/611, 617, 618, 623; 248/309.2, 328, 317

[56] References Cited

U.S. PATENT DOCUMENTS

| | | | |
|---|---|---|---|
| 1,973,616 | 9/1934 | Fleeman | 40/618 |
| 2,689,423 | 9/1954 | Atkin | 40/618 |
| 3,022,591 | 2/1962 | Faulkner | 40/618 |
| 3,028,700 | 4/1962 | Faulkner | 40/618 |
| 4,184,277 | 1/1980 | Larin | 40/611 |
| 4,411,084 | 10/1983 | Kraus | 40/623 |

FOREIGN PATENT DOCUMENTS

| | | | |
|---|---|---|---|
| 1177403 | 4/1959 | France | 40/623 |
| WO91/12603 | 8/1991 | PCT Int'l Appl. . | |
| 1568657 | 6/1980 | United Kingdom . | |
| 1570334 | 6/1980 | United Kingdom . | |

*Primary Examiner*—Kenneth J. Dorner

*Assistant Examiner*—C. Hope Davis

*Attorney, Agent, or Firm*—Fay, Sharpe, Beall, Fagan, Minnich & McKee

[57] ABSTRACT

A sign assembly includes a plurality of rectangular display panels or slats which have a front surface for displaying written or graphic information and a planar obverse surface. The obverse surface has a pair of relatively narrow linear, parallel extending channels defined therein. Each channel is enlarged within an interior of the panel portions, preferably with a substantially circular transverse cross-section. The enlarged portion is larger in cross-section than the channel portion such that reaction surfaces are defined adjacent the channel portion facing toward the front of the panel. A mounting assembly includes an integral attaching plate which has a generally planar forward face for engaging the obverse surface of the display panels. A neck or web portion which adapted to be slidingly received in the channel portion of the panels is integrally connected with the attachment plate. An enlarged rod member with substantially the same cross section as the enlarged passage portion in the display panel is integrally connected with the web. The rod and web portion are slidably received within the channel and enlarged portion of a plurality of channels to provide a composite display.

15 Claims, 5 Drawing Sheets

SIGN ASSEMBLIES

This invention relates to sign assemblies and in particular, though not exclusively, to sign assemblies having a plurality of interchangeable display panels or other display members.

There have previously been proposed sign assemblies having a number of separate display panels disposed adjacent one another so as conveniently to provide information, for example information relating to separate subjects, at a single location. Some of these multi-display sign assemblies have been put on the market. However, all of these assemblies that have been put on the market have included a separate sheet-like backing member to support, or act as a backing for, the display panels. This backing, although not itself part of the sign, has previously been though to be necessary despite the substantial disadvantages thereby incurred, for example, increased weight and/or size of the assembly and the consequent increase in cost.

The present invention now provides sign assemblies which avoid the disadvantages referred to above. Moreover, in preferred forms of the invention, the absence of a sheet-like backing member permits a design assembly of enhanced appearance and utility. In particular, the present invention provides a sign assembly which can readily be assembled and dismantled so that, using interchangeable display panels, the information presented by the assembly can readily be changed.

Accordingly, in one aspect the present invention provides a sign assembly which comprises:

a mounting member comprising an elongate member and an attachment means for securement of the elongate member to a wall or other support;

at least one display panel mountable on the elongate member, the panel having formed therein an engagement channel for engagement with the elongate member whereby said at least one display panel can be slidably mounted on, and slidably demounted from, the elongate member; and means to retain said at least one display panel in place on the elongate member.

In a preferred form of the invention the mounting member comprises a rod (which can be solid or hollow) and the attachment means comprises an elongate plate secured to, or integral with, the rod. This latter form of mounting member is conveniently an extruded profile of aluminum or other suitable metal or of a plastics material.

Where the display panel or panels are in the form of slats, strips or of other elongate shape, it has been found convenient to use two mounting members disposed respectively at the opposed end portions of the slats or strips.

Although the invention includes sign assemblies where there is only one display panel, it is concerned particularly with assemblies where there are two or more interchangeable display panels, and it is with particular reference to such assemblies that the following description relates. The display panels are normally of rectangular shape though, if desired, panels of other shapes can be used. The display panels are conveniently parallel to one another and conveniently in the same plane though, if desired, some of the display panels can be in one plane and the others in one or more other planes.

If desired, the display panel or, where there is more than one display panel, the lower or lowermost one, can be disposed on a retaining slat or other retaining member. Similarly, a retaining slat or other retaining member can be disposed on top of the upper surface of the display slat or, where there is more than one display slat, the upper or uppermost one. In the preferred embodiments described with reference to the accompanying drawings the sign assemblies have both upper and lower retaining slats.

The means to retain the display panel or panels (and any retaining rail or rails) in place on the elongate member or members can take one of a variety of forms. In one form the means can simply be frictional, for example by using panels whose engagement channel closely embraces the elongate member to an extent such that, although the panel can be slid onto the elongate member, for example by hand, the frictional force between the panel and the rod is such that the panel does not slide off the rod under the force of gravity. However, in general, it is preferred to have separate means to retain the display panel in place on the rod. One such means comprises a securement member to hold in position at the bottom of the rod the lowermost display panel or a retaining rail or other member. The securement means can, for example, be a screw-threaded bolt tapped into a recess in the lower end portion of the rod. Any other display panel can then be slid onto the rod so as to rest on the lowermost display panel, and this arrangement is most satisfactory where the rod is disposed substantially vertically. However, if desired, a similar or other retention means can be used at the upper end of the rod. An arrangement of this sort utilising upper and lower retaining rails or slats is described below, by way of example, with reference to the accompanying drawings.

Sign assemblies according to preferred embodiments of the present invention have the following advantages:

(a) they provide great flexibility of operation as to slat depth and width for example up to 1200 mm × 3000 mm;

(b) they can be manufactured in a variety of materials for example, medium density fibreboard (MDF), hardwood, metal or plastics material;

(c) the slat profile is easily variable;

(d) the slats slide off vertically which minimises the space needed to remove slats;

(e) projecting sign assemblies can be suspended from points other than the top, i.e. the support rod can be within the top half of the sign; and (f) the sign assembly can be made in a wide variety of thicknesses.

In another form of the invention the mounting member includes a second elongate member disposed substantially parallel to said elongate member and said at least one display panel has formed therein a second engagement channel substantially parallel to said engagement channel whereby said at least one display panel can be slidably mounted on, and slidably demounted from, the elongate members.

In a further form of the invention said at least one display panel comprises two sub-panels one of which is slidably mounted on said elongate member and the other of which is slidably mounted on said second elongate member, the sub-panels when slidably mounted on the elongate members being in end-to-end relationship and together provide a composite elongate display.

There is now described, by way of example and with reference to the accompanying drawings, preferred embodiments of the sign assembly of the present invention.

Figure 1:
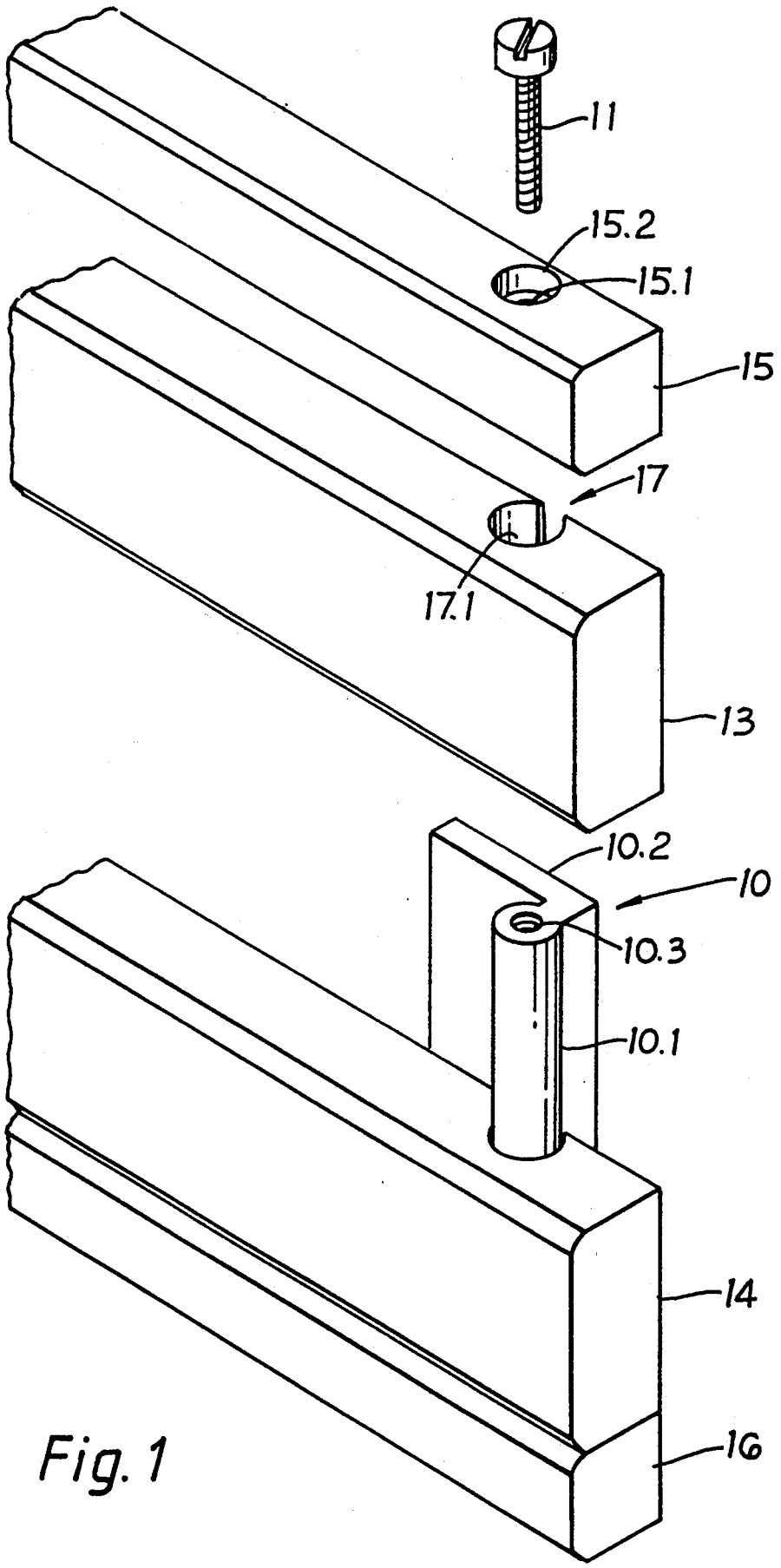
FIG. 1 is an exploded perspective view of the assembly.

The sign assembly shown in FIG. 1 comprises a mounting member (10) having a vertically extending elongate hollow rod or tube (10.1) formed integrally with a securement plate (10.2) disposed parallel with and extending along the whole length of the elongate rod (10.1). The mounting member can be of any suitable material, for example it can be an extruded aluminum profile. The mounting member is provided with apertures (not shown) to receive screws for securing it on a wall or other support. The elongate rod is tapped at its upper and lower ends (10.3, 10.4) to receive upper and lower screw-threaded retaining bolts (11, 12). The assembly shown in FIG. 1 includes upper and lower display panels (13, 14) in the form of elongate display slats and upper and lower retaining slats (15, 16). FIG. 1 shows only one end of the slats (13, 14, 15, 16) but their opposite ends are formed in similar fashion and are provided with a corresponding mounting member and upper and lower screw-threaded retaining bolts.

Upper retaining slat (15) has formed therein a cylindrical channel (15.1) to pass the shank of the bolt (11), the channel having a countersunk enlargement (15.2) to accommodate the head of the bolt (11). Retaining slat (16) is formed similarly to accommodate the lower retaining bolt (12).

The display slats and the retaining slats each include an open channel (17) disposed transverse to their length, the channel being of shape and dimensions such that it is a sliding fit on the elongate member whereby the slats can be moved upwardly and downwardly with respect to the mounting member. In position on the mounting members the slats are disposed substantially parallel to one another and in substantially the same plane; they are normally in surface-to-surface contact with one another though, if desired they can be spaced apart, for example by use of spacers mounted on the mounting members or otherwise. If desired the slats can be disposed so that some are in one plane and others in at least one another plane.

The configuration of the open channels in the slats is now described with reference to that in display slat (13).

Figure 3:
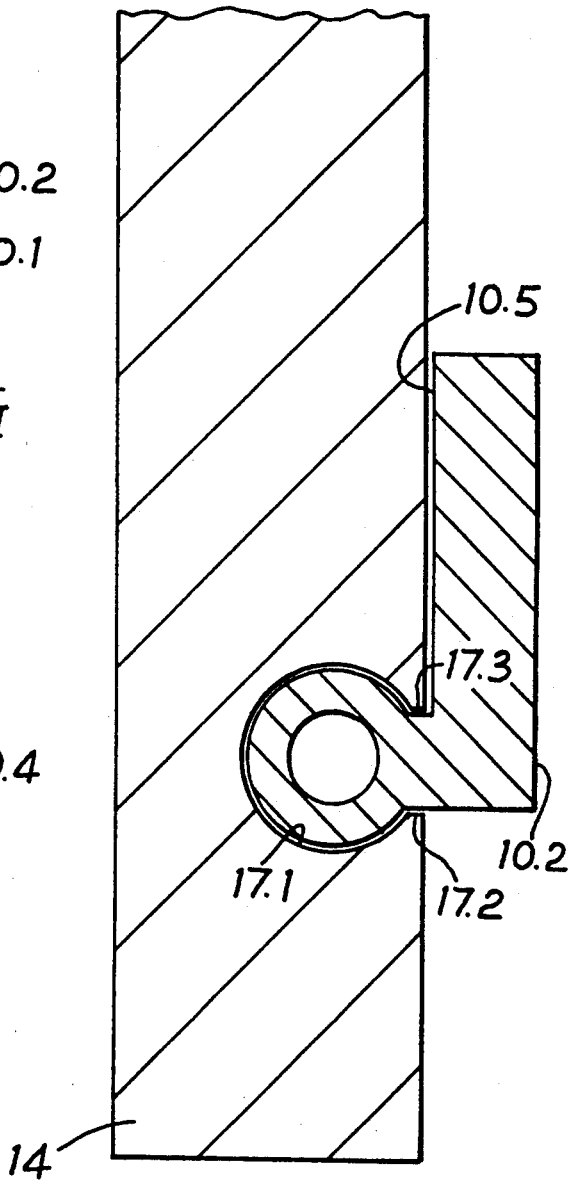
FIG. 3 is a cross-section taken on the line III—III of FIG. 2.

The open channel (17) is bounded by an arcuate surface (17.1) whose end portions terminate in reaction surfaces (17.2, 17.3) (FIG. 3).

Although the sign assemblies of the embodiment described with reference to the accompanying drawings have two parallel mounting members, the invention includes sign assemblies having only the single mounting member actually depicted in the drawings. In such assemblies rotation in a clockwise direction of slat (14) on rod (10.1) is substantially prevented by the adjacent surface (10.5) of attachment member (10.2) and also by reaction surface (17.3); and rotation in an anticlockwise direction is substantially prevented by reaction surface (17.2). Of course, such rotations could also be prevented by use of a rod whose cross-section is other than circular. However, the invention is not limited to assemblies in which the slats are not rotatable on the mounting members.

Figure 2:
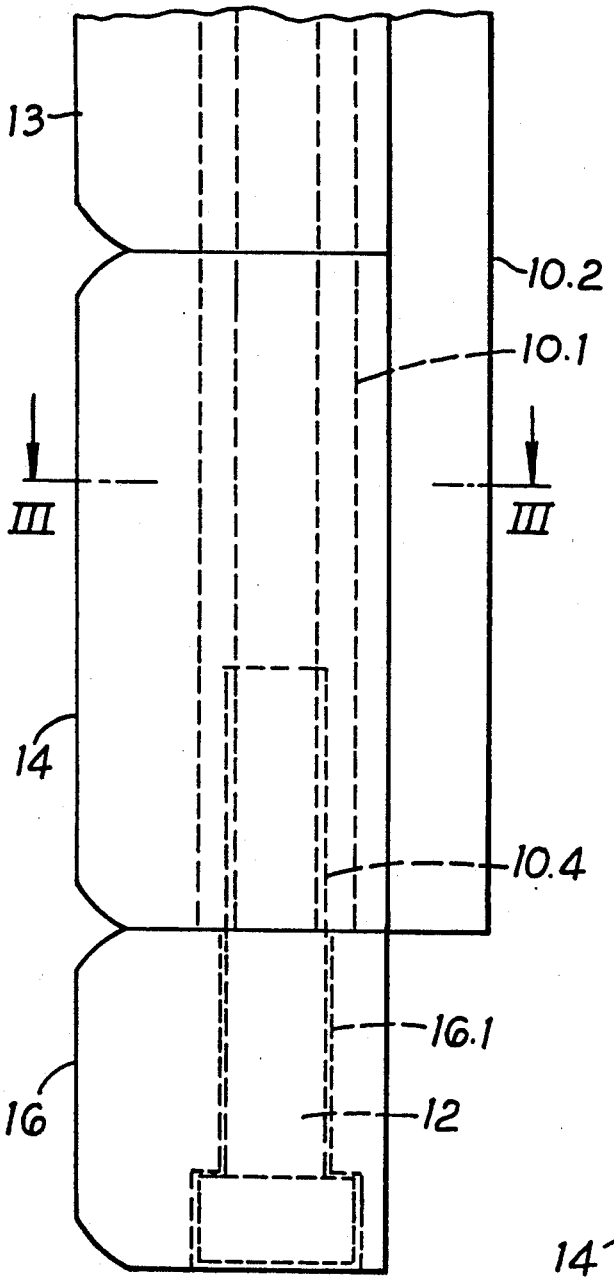
FIG. 2 is an end elevation of the lower part of the sign assembly of FIG. 1 in its assembled condition.

The sign assembly shown in FIGS. 1 to 3 can, for example, be assembled as follows. First, the lower display slat (14) is aligned with the lower retaining slat (16) as shown in FIG. 2 and the lower retaining bolt (12) is inserted through aperture (16.1) and screwed into the lower end of the mounting member at tapped hole (10.4). Similar action is taken at the opposed ends of slats (14, 16) with regard to the second mounting member (not show).

Then, the upper display slat (13) is presented to the upper ends of the two mounting members and slid downwardly along the elongate rods until it rests on the upper surface of slat (14). The upper retaining slat (15) is then slid on to the upper ends of the two mounting members and secured therewith by means of retaining bolt (11) in tapped hole (10.3) and the corresponding retaining bolt in the tapped hole in the second mounting member.

Figure 4:
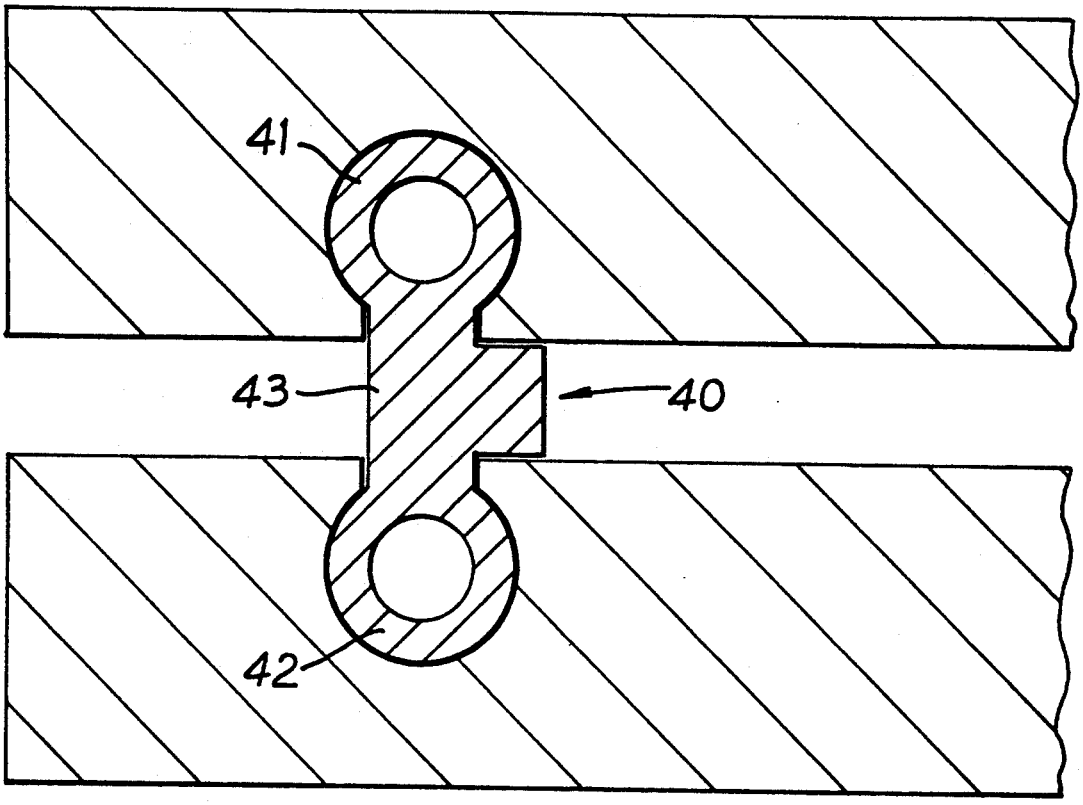
FIG. 4 is a cross-section corresponding to that of FIG. 3 but with reference to a double-sided sign.

With reference to FIG. 4, the mounting member (40) comprises two parallel elongate hollow rods (41, 42) carried by an integral with attachment means (43). The mounting member can be of any suitable material, for example an extruded aluminium profile.

Apart from the fact that the mounting member (40) has two elongate rods instead of the single elongate rod of the mounting member of FIGS. 1 to 3, the means by which the display slats are mounted and held in position corresponds to the arrangement of FIGS. 1 to 3.

Figure 5:
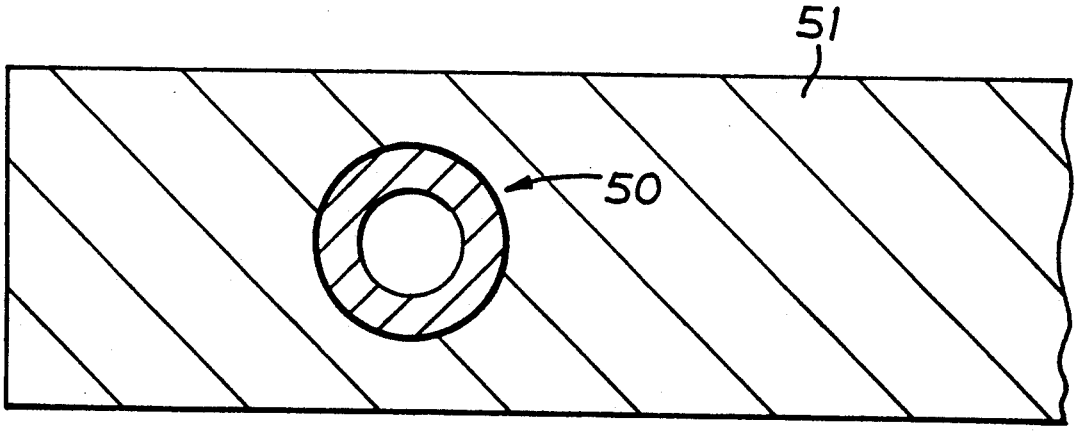
FIG. 5 is a cross-section corresponding to that of FiG. 3 but incorporating an alternative mounting member.

With reference to FIG. 5, the mounting member (50) consists of an elongate hollow rod without a securement means corresponding to that of the embodiments of FIGS. 1 to 3 and FIG. 4. Accordingly, the channel formed in the slat (51) is cylindrical and the slat is slidable with respect to the mounting member. It is not necessary to have upper and lower retaining slats. A suitable means of mounting this embodiment is by means of a suspension wire or other suspension means which passes through the hollow rod and is secured at its lower end to a platform member of shape and dimensions such that the slat (or the lowermost slat, as the case may be) is supported thereon.

Figure 6:
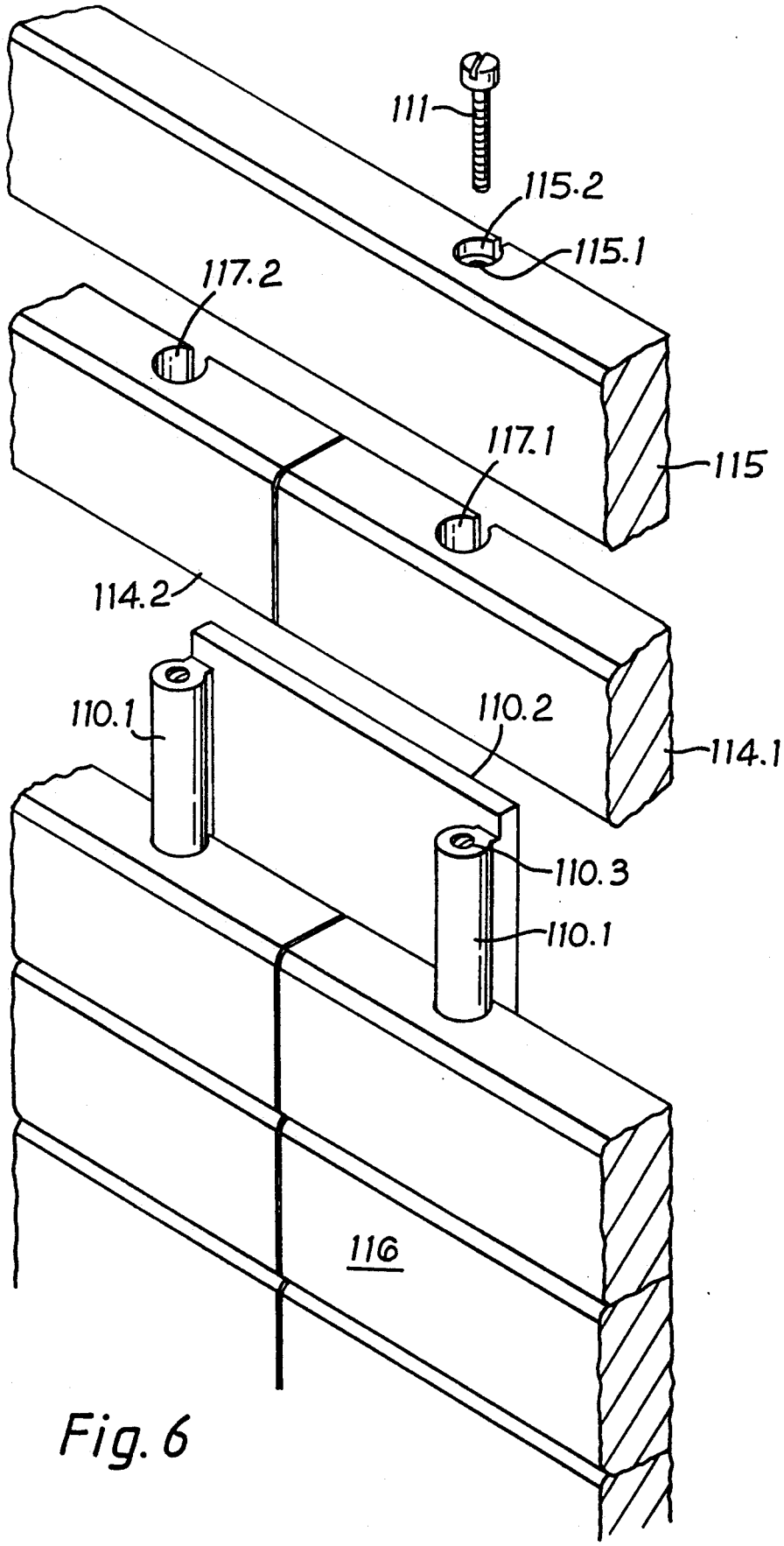
FIG. 6 is an exploded perspective view of an assembly which is a second embodiment of the invention.
Figure 7:
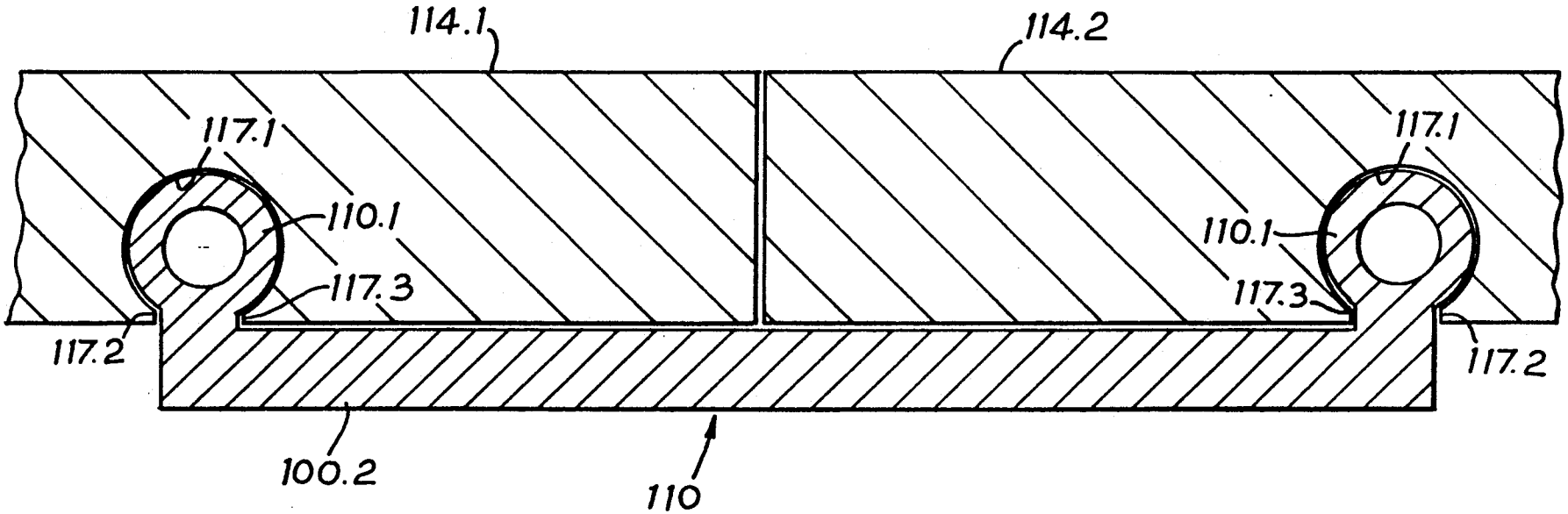
FIG. 7 is a cross-section of the mounting member of the assembly of FIG. 6.

The sign assembly shown in FIGS. 6 and 7 comprises a mounting member (110) having two, like, parallel, vertically extending elongate rods or tubes (110.1) formed integrally with a securement plate (110.2). The ends of rods (110.1) stop short of the respective edges of plate (110.2). The mounting member can be of any suitable material, for example it can be an extruded aluminium profile. The mounting member is provided with apertures (not shown) to receive screws for securing it on a wall or other support. The elongate rods are tapped at their upper (110.3) and lower ends to receive upper and lower screw-threaded retaining bolts of which upper bolt (111) is shown in FIG. 6. The assembly shown in FIG. 6 includes two, like display panels (114.1, 114.2) in the form of elongate display slats and upper and lower retaining slats (115, 116). FIG. 1 shows only the upper portion of mounting member (110); its lower portion is formed in similar fashion and is provided with corresponding upper and lower screw-threaded retaining bolts.

Upper retaining slat (115) has formed therein a cylindrical channel (115.1) to pass the shank of the bolt (111), the channel having a countersunk enlargement (115.2) to accommodate the head of the bolt (111). Retaining slat (116) is formed similarly to accommodate the lower retaining bolt.

The display slats and the retaining slats each include open channels (117.1, 117.2) parallel to each other and disposed transverse to their length, the channels being of shape and dimensions such that they are a sliding fit on the elongate members whereby the slats can be moved upwardly and downwardly with respect to the mounting member. In position on the mounting member the slats (114.1, 114.2) are disposed substantially in line with each other and in substantially the same plane; at their ends they can be in surface-to-surface contact with each other though, if desired, they can be spaced apart, for example by use of spacers or otherwise. If desired, the slats can be disposed so that some are in one plane and others in at least one other plane.

The configuration of the open channels (117.1, 117.2) in the slats is substantially the same as in the first embodiment described above with reference to FIGS. 1 to 3.

However, it will be appreciated that, where the slats (114.1, 114.2) are contiguous at their adjacent end portions, the surfaces (117.2 and 117.3) do not need to act as reaction surfaces.

I claim:

1. A composite sign assembly comprising:

at least one display panel including:

a front face which adapted to carry information, a flat rear face, a pair of parallel extending engagement channels, each engagement channel including (i) a narrow channel portion defined in the rear face and (ii) an enlarged channel portion connected with the narrow channel portion and defined within an interior of the display panel, each enlarged channel portion having a substantially uniform transverse cross-section along a longitudinal length thereof;

a mounting assembly including:

an attachment means for attaching the composite sign assembly to an associated structure, the attachment means having at least one generally planar face portion which slidably engages the display panel rear face, a pair of vertically oriented narrow web portions extending forward from the attachment means, the web portions being linear, disposed parallel to each other, and dimensioned for slidable receipt in the display panel narrow channel portions, a pair of enlarged rod portions, each enlarged rod portion being integrally connected with one of the web portions, the enlarged rod portions being slidably received in the enlarged channel portions with the display panel rear face engaging the attachment means planar face; and a separate retaining means attached to said mounting assembly for releasably retaining the display panel on the rod portions.

2. A sign assembly according to claim 1, wherein said at least one display panel is a rectangular slat having a major longitudinal axis and a minor transverse axis, and said engagement channel is disposed at a right angle to said major longitudinal axis.

3. A sign assembly according to claim 1, wherein the rod portion is of circular cross-section and said engagement channel enlarged portion has a bounding cylindrical surface of a corresponding substantially circular cross-section.

4. A sign assembly according to claim 1, wherein said at least one display panel includes a plurality of like, interchangeable slats which are mounted abutting and substantially parallel to one another on said enlarged rod portions to provide a composite display.

5. The sign assembly according to claim 1 wherein the attaching means includes an attaching plate, the attaching plate, the web portions, and the rod portion being integral.

6. A composite sign assembly comprising:

a plurality of rectangular display panels, each display panel including:

a pair of linearly extending engagement channels which extend a length thereof, the engagement channels each being a preselected distance from and extending parallel to an adjacent display panel edge, each engagement channel including a relatively narrow channel portion through a rear face of the panel and an enlarged channel portion of substantially constant transverse cross-section within the panel, the narrow channel portion being connected with and providing access to the enlarged channel portion;

a mounting assembly for mounting the plurality of panels to an associated structure, the mounting assembly including:

an attaching means for selectively attaching the composite sign assembly with the associated structure, at least a pair of web portions connected in parallel to the attachment means, the pair of web portions being dimensioned for longitudinal sliding receipt in one of the narrow channel portions of each of a pair of the display panels, at least a pair of enlarged rod portions dimensioned for longitudinally sliding receipt in the enlarged channel portions of the pair of display panels, each enlarged rod portion being connected with one of the web portions;

a separate means attached to said mounting assembly for releasably retaining the display panels on the rod members.

7. A composite sign assembly according to claim 6 wherein the attaching means includes a plate to which the pair of web portions and the pair of rod portions are mounted parallel to each other and displaced by twice the preselected distance, such that each of the web and rod portions is received in the engagement channel of a different one of a pair of display panels that abut end to end.

8. A composite sign assembly according to claim 6 wherein the attaching means includes a plate member having a pair of generally planar faces on opposite sides thereof, the pair of web portions each being connected to one of the opposite faces for receipt in the engagement channels of a pair of display panels that are mounted back to back with their rear faces contacting the plate member planar faces.

9. A composite sign assembly comprising:

a plurality of rectangular display panels, each display panel including:

a front face which is adapted to carry information, a flat rear face, a pair of engagement channels defined in the rear face and extending parallel to each other, the engagement channels each including an enlarged channel portion having a substantially uniform transverse cross-section along a longitudinal length thereof and a narrow channel portion which defines an access opening along the rear face to the enlarged channel portion;

a mounting assembly including:

at least a pair of longitudinally elongated members having substantially the same transverse cross section as the engagement channels, the elongated members being slidably received in the engagement channels of a plurality of the rectangular display panels stacked parallel to each other to provide a composite display, an attachment means for attaching the elongated members in a vertical orientation to an associated structure;

a separate retaining means attached to said mounting assembly for releasably retaining the display panels on the elongated members.

10. A sign assembly according to claim 9, which the retaining means includes a support member attached to said attachment means to support said at least one display panel on the elongate member.

11. A sign assembly according to claim 10, wherein the support member comprises a rail having means to secure the at least one display panel to a lower portion of said elongate members.

12. A sign assembly according to claim 10, which includes a retaining member to cap said at least one display panel and retain the at least one display panel in place on the elongate members.

13. The sign assembly as set forth in claim 9 wherein the attachment means includes a plate having a forward face that engages the rear face of the rectangular display panels for holding the rectangular display panels parallel to each other; and wherein the elongated members include a rod portion that is slidably received in the engagement channel enlarged portion and a web portion that connects the rod portion and the plate.

14. The sign assembly as set forth in claim 9 wherein the elongated members include a threaded axial bore and the retaining means includes a screw member that includes:

a threaded shank portion that is threadedly received in the elongated member threaded axial bore;

an enlarged head portion with a larger cross section than the engagement channel enlarged portion for retaining the rectangular display panels thereon.

15. A sign assembly according to claim 14, wherein said elongate member includes a tubular rod having a central bore that is internally threaded at one end.

* * * * *